US008961243B2

(12) United States Patent
Asakuma et al.

(10) Patent No.: US 8,961,243 B2
(45) Date of Patent: Feb. 24, 2015

(54) ELECTRIC WIRE POSITIONING MEMBER AND ATTACHMENT PLUG INCLUDING THE SAME

(75) Inventors: Yoshiaki Asakuma, Mie (JP); Takashi Kawamoto, Mie (JP); Toshiyuki Takii, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 148 days.

(21) Appl. No.: 13/544,305

(22) Filed: Jul. 9, 2012

(65) Prior Publication Data

US 2013/0017713 A1 Jan. 17, 2013

(30) Foreign Application Priority Data

Jul. 11, 2011 (JP) ..... 2011-153123

(51) Int. Cl.
*H01R 13/502* (2006.01)
*H01R 13/58* (2006.01)
*H01R 24/30* (2011.01)

(52) U.S. Cl.
CPC ..... *H01R 13/5833* (2013.01); *H01R 24/30* (2013.01)
USPC ..... 439/695

(58) Field of Classification Search
USPC ..... 439/470, 695
See application file for complete search history.

(56) References Cited

U.S. PATENT DOCUMENTS 1,036,551 A * 8/1912 Both ..... 439/457
2,713,669 A * 7/1955 Cahn ..... 439/457
3,360,766 A * 12/1967 Schumacher ..... 439/472
3,408,618 A * 10/1968 Hubbell ..... 439/695
3,461,417 A * 8/1969 Schumacher et al. ..... 439/106
3,793,607 A * 2/1974 Smith et al. ..... 439/695
5,953,815 A * 9/1999 Kaminski et al. ..... 29/860
6,232,552 B1 * 5/2001 Balzano ..... 174/60
6,802,744 B2 * 10/2004 Chiang ..... 439/701
2008/0280471 A1 * 11/2008 Perez ..... 439/248

FOREIGN PATENT DOCUMENTS

JP 2001-35597 2/2001
TW 547818 8/2003

OTHER PUBLICATIONS

Taiwanese Office action dated Jul. 7, 2014, along with an English-language translation thereof.

* cited by examiner

*Primary Examiner* — Phuong Dinh
(74) *Attorney, Agent, or Firm* — Greenblum & Bernstein, P.L.C.

(57) ABSTRACT

An attachment plug includes: a plurality of plug pins; a plurality of screw terminal blocks electrically connected to the corresponding plug pins, respectively; a body block accommodated within a shell for holding the screw terminal blocks; and an electric wire positioning member for holding the electric cords included in a multi-core cable introduced into the shell from outside in the state where the electric cords are positioned to correspond to the respective screw terminal blocks. The electric wire positioning member includes a plurality of hooking pieces for holding the electric cords exposed outside by stripping a sheath of the multi-core cable in the state where the electric cord are positioned to correspond to the respective screw terminal blocks.

5 Claims, 12 Drawing Sheets

ELECTRIC WIRE POSITIONING MEMBER AND ATTACHMENT PLUG INCLUDING THE SAME

FIELD OF THE INVENTION

The present invention relates to an electric wire positioning member and an attachment plug including the same.

Conventionally, there is known a power plug to be inserted into a receptacle (e.g., Japanese Unexamined Patent Application Publication No. 2001-35597). In the power plug disclosed in the above cited reference, a plurality of plug pins is held by a holding body accommodated in an external cover. Inner wires of a power cable, introduced into the external cover, are connected to respective connecting terminals corresponding to the plug pins. Herein, when the inner wires are connected to the connecting terminal corresponding to the respective plug pins, an operator strips a sheath of the power cable to expose the inner wires, and then removes insulation coatings of the respective inner wires to connect them to the corresponding connecting terminals.

In the conventional power plug as described above, the extra length of the inner wires, exposed by stripping the sheath of the power cable, is accommodated in the external cover. This enlarges the external cover in size by an amount corresponding to the extra length of the inner wires accommodated therein. Further, if the extra length of the inner wires is disposed outside the external cover for the purpose of downsizing the power plug, the inner wires, not covered with the sheath, are exposed to the outside of the external cover, which deteriorates external appearance of the power plug. Furthermore, since the inner wire is not covered with the sheath of the power cable, the protection of the inner wires becomes insufficient. For downsizing the power plug, the extra length of the inner wires is preferably shortened as much as possible. In the case of shortening the extra length of the inner wires, however, if the connecting terminals are arranged at intervals, it becomes difficult to connect the inner wires the corresponding connecting terminals. This deteriorates the working efficiency.

SUMMARY OF THE INVENTION

In view of the above, an object of the present invention is to provide an electric wire positioning member capable of connecting an electric wire to a terminal block effectively even if an extra length of electric wire is short, and an attachment plug including the same.

In accordance with an aspect of the present invention, there is provided an electric wire positioning member including: a first positioning restriction part for holding a plurality of electric cords, which is exposed outside by stripping a sheath covering the electric cords to be connected to corresponding terminal blocks, in the state where the electric cords are positioned to correspond to the terminal blocks.

In the electric wire positioning member, the first positioning restriction part may include a first restriction part and a second restriction part. The first restriction part positions roots of the electric cords exposed from the sheath covering the electric cords. The second restriction part positions tip end portions of the electric cords to be connected to the corresponding terminal blocks.

In the electric wire positioning member, a protruding portion may be provided on a main body including the first positioning restriction part, wherein the protruding portion is adapted to be engaged with a recess portion provided on a body block to which the terminal blocks are attached.

In the electric wire positioning member, a second positioning restriction part may be provided in the main body to restrict the sheath covering the electric cords from being inserted toward the terminal blocks beyond a predetermined position.

In accordance with another aspect of the present invention, there is provided an attachment plug including: a plurality of plug pins, a plurality of terminal blocks, a body block, and the electric wire positioning member described above. The terminal blocks are electrically connected to the corresponding plug pins. The body block, holding the terminal blocks, is accommodated within a shell. The electric wire positioning member holds the electric cords included in a multi-core cable introduced into the shell from the outside, in the state where the electric cords are positioned correspond to the terminal blocks.

In the attachment plug, the electric wire positioning member may be provided with a main body including the first positioning restriction part, wherein the main body is provided with a protruding portion protruding toward the body block. In this case, the body block is provided with a positioning part to be engaged with the protruding portion to position the electric wire positioning member.

According to the present invention, the electric wires can be connected to the corresponding terminal blocks effectively even if the extra length of each electric wire is short.

BRIEF DESCRIPTION OF THE DRAWINGS

The objects and features of the present invention will become apparent from the following description of embodiments, given in conjunction with the accompanying drawings, in which:

FIGS. 1A and 1B show an attachment plug in accordance with an embodiment of the present invention, wherein FIG. 1A is a perspective view showing the state where an electric wire positioning member is placed on a body block, and FIG. 1B is a perspective view showing the state before the electric wire positioning member is placed on the body block;

FIGS. 2A to 2C show the attachment plug, wherein FIG. 2A is a front view, FIG. 2B is a top view, and FIG. 2C is a right side view;

FIGS. 6A to 6C show a screw terminal block used for the attachment plug, wherein FIG. 6A is an exploded perspective view, FIG. 6B is an external perspective view viewed from its front side, and FIG. 6C is an external perspective view viewed from its rear side;

FIGS. 7A and 7B show the attachment plug, wherein FIG. 7A is a perspective view of the body block viewed from its rear side, and FIG. 7B is a perspective view of a body viewed from its rear side;

FIGS. 9A to 9C show a modification of the attachment plug shown in FIGS. 1A and 1B, wherein FIG. 9A is a perspective view showing the state where the electric wire positioning member is placed on the body block, FIG. 9B is a perspective view showing the state before the electric wire positioning member is placed on the body block, and FIG. 9C is a perspective view of the electric wire positioning member viewed from its lower side.

DETAILED DESCRIPTION OF THE EMBODIMENT

Figure 1A:
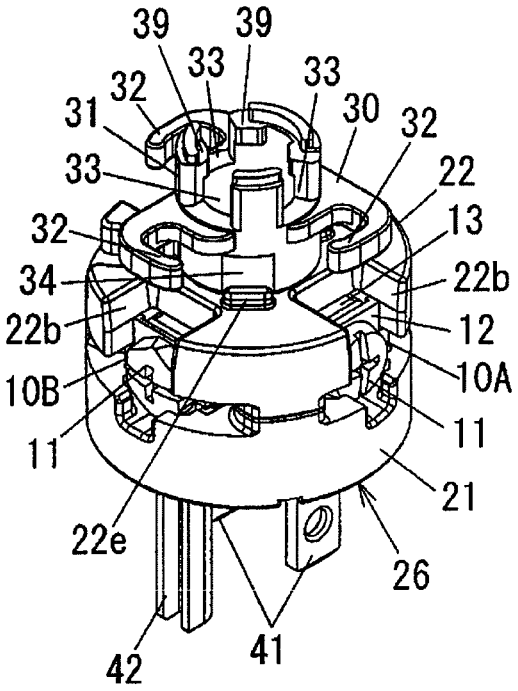
Figure 1B:
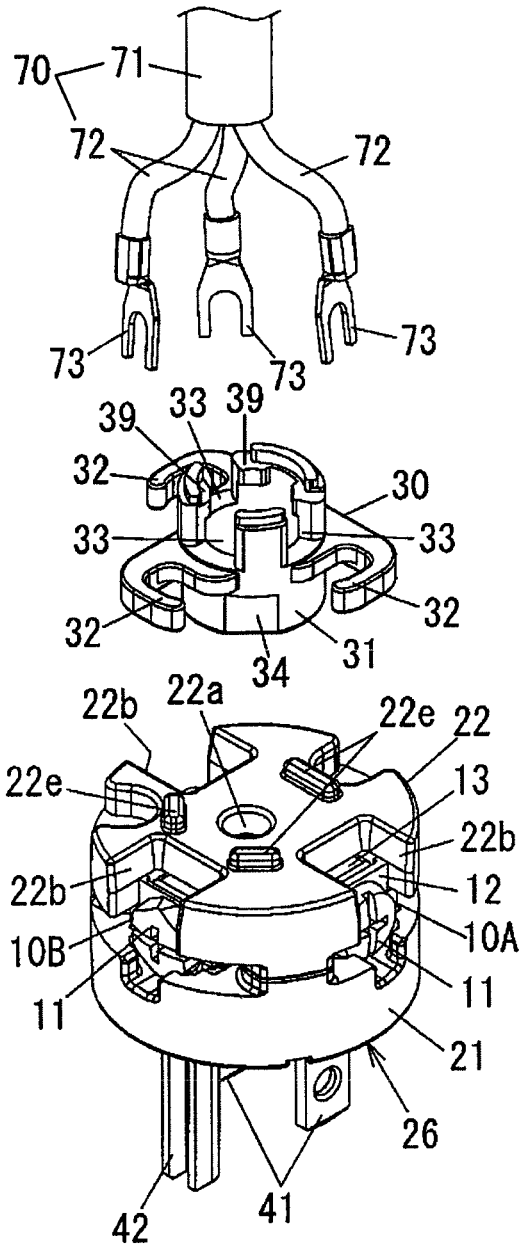
Figure 2A:
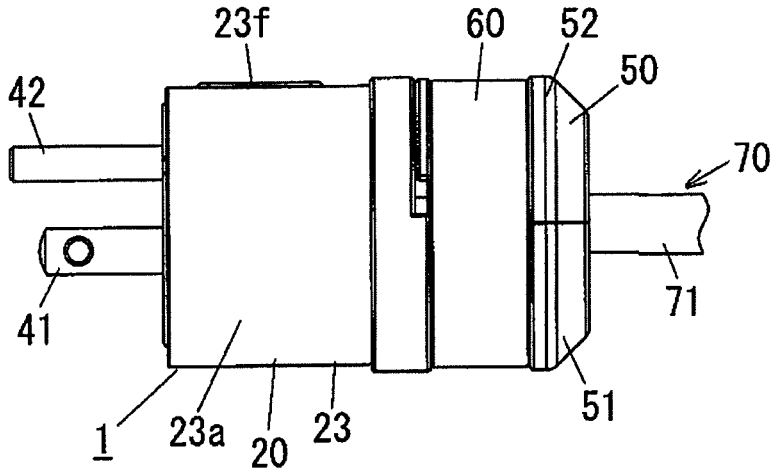
Figure 2B:
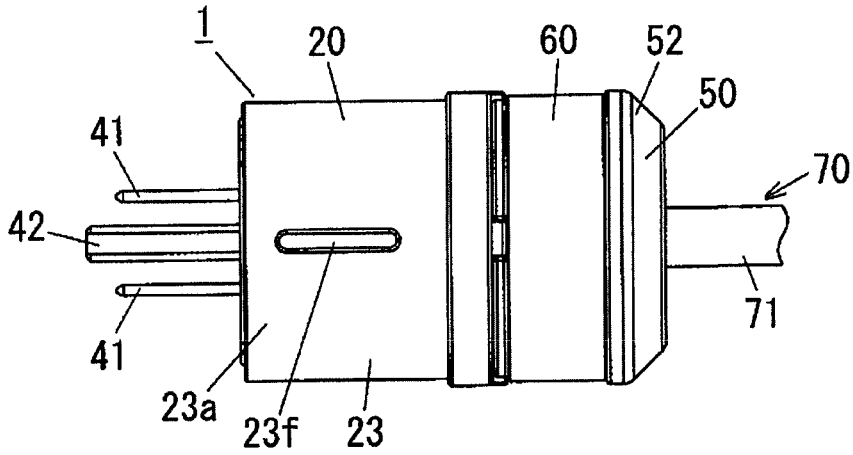
Figure 2C:
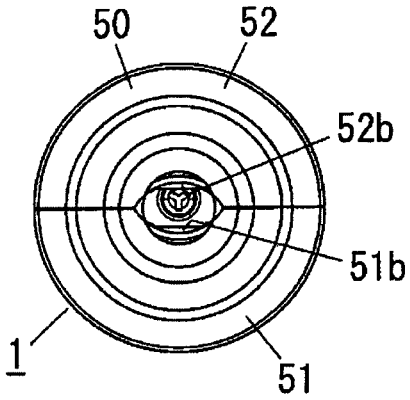
Figure 3:
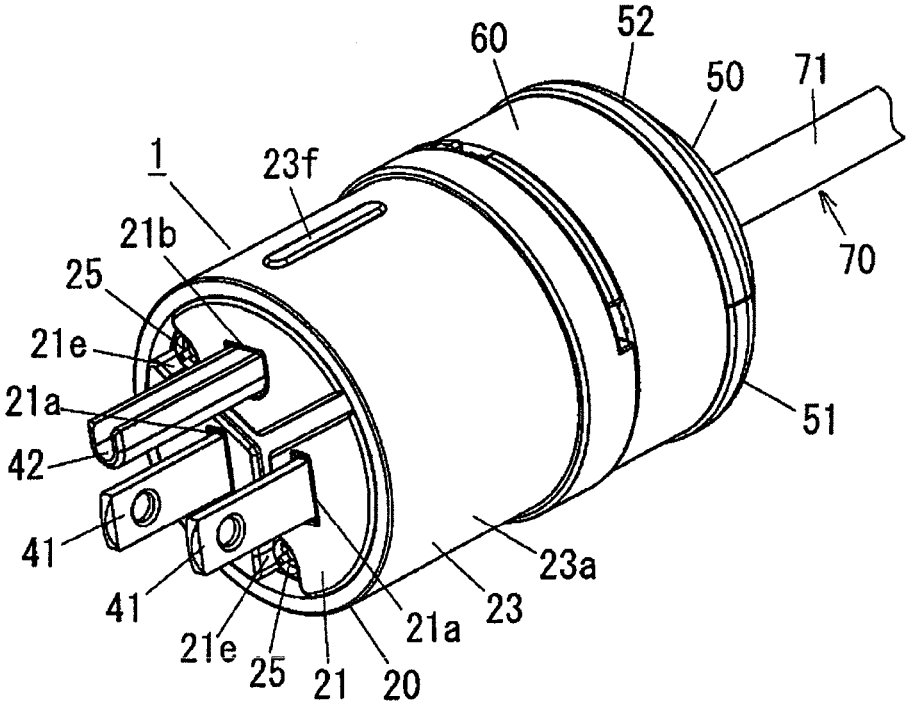
FIG. 3 is an external perspective view of the attachment plug.
Figure 4:
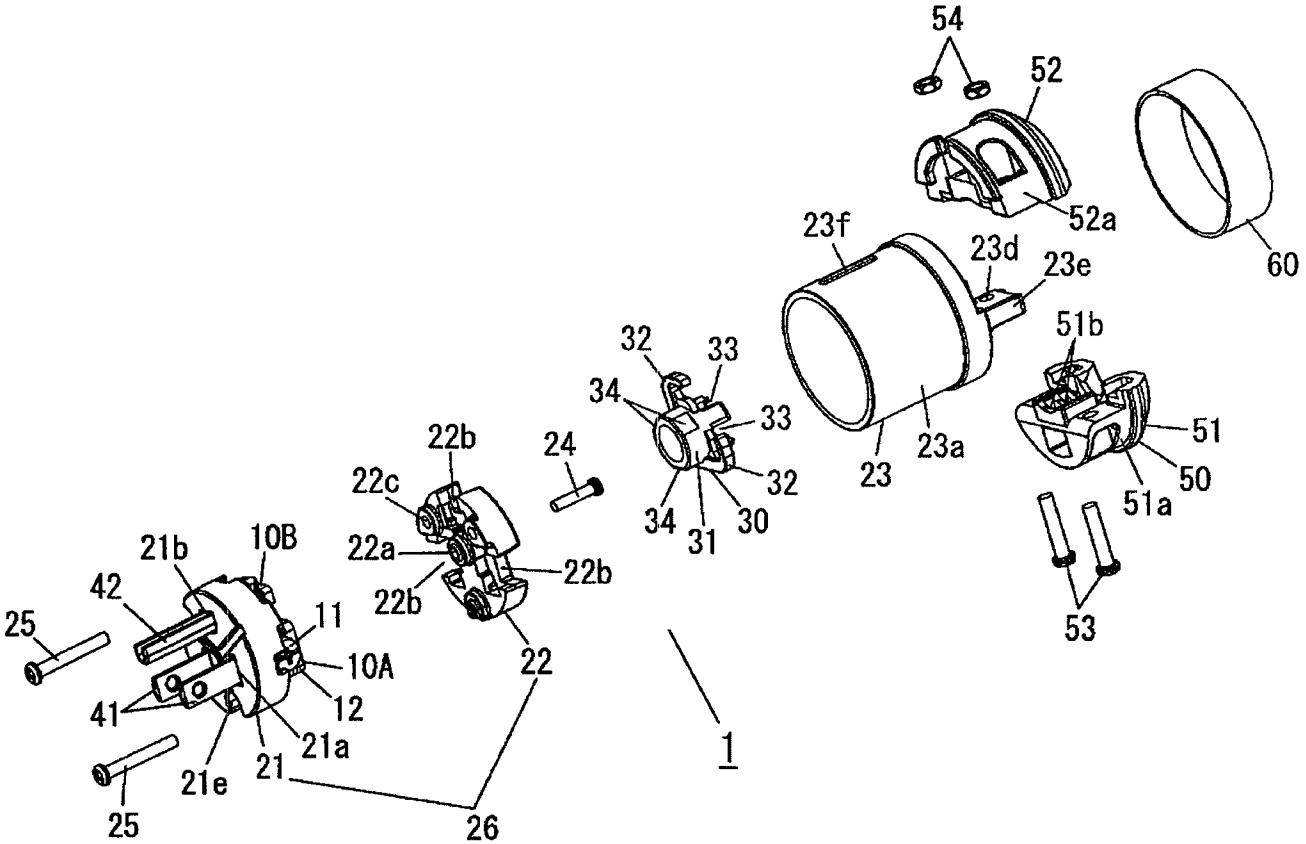
FIG. 4 is an exploded perspective view of the attachment plug viewed from its front side.
Figure 5:
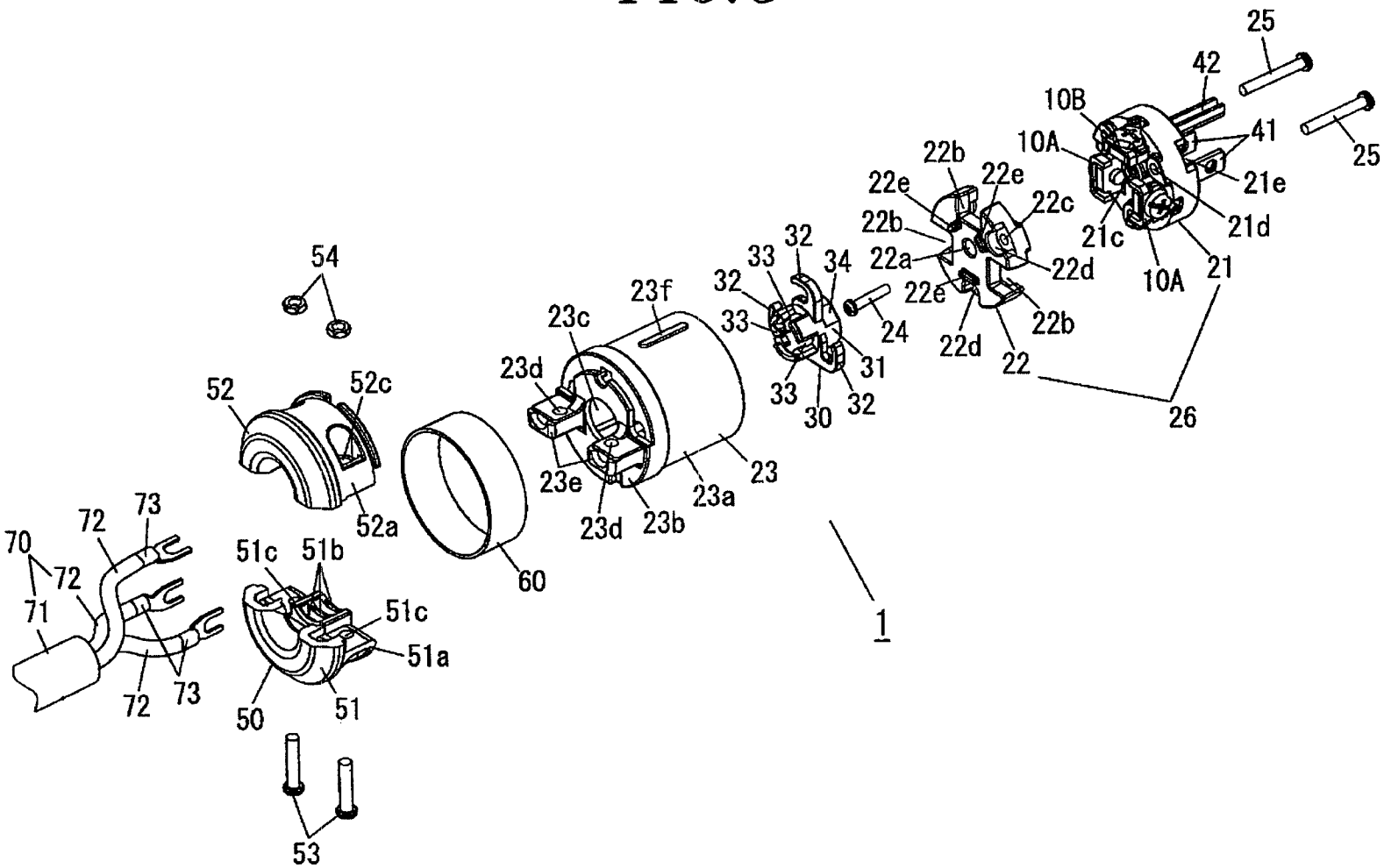
FIG. 5 is an exploded perspective view of the attachment plug viewed from its rear side.

Hereinafter, an electric wire positioning member and an attachment plug including the same in accordance with embodiments of the present invention will be described in detail with reference to the drawings. The attachment plug of the present embodiment, e.g., used for a charging cable of an electric vehicle (including a hybrid electric car and a plug-in hybrid electric car), is connected to a receptacle of a charging station installed in a store, a business facility, and the like, or a wall socket of a dwelling, in a charging mode of the electric vehicle. Note that, in the following description of the attachment plug, unless otherwise noted, up-down direction in FIG. 2A is defined as an up-down direction, left-right direction in FIG. 2A is defined as a front-rear direction, and up-down direction in FIG. 2B is defined as a left-right direction, but actual directions in which the attachment plug 1 is in use are not limited to the above directions.

The attachment plug 1 mainly includes a triple of screw terminal blocks 10A, 10A and 10B, a plug body 20, an electric wire positioning member 30, two power plug pins 41 (W-pole and L-pole), a ground plug pin 42, an electric wire clamping part 50, and an elastic band 60.

The screw terminal blocks 10A, 10A and 10B are accommodated in the plug body 20. The power plug pins 41 are provided in the screw terminal blocks 10A, and the ground plug pin 42 is provided in the screw terminal block 10B. These plug pins 41 and 42, protruding outward from a front surface of the plug body 20, are plug-in connected to a plug receiver (not shown) such as a receptacle, or an extension socket. Note that the screw terminal block 10B differs from the screw terminal block 10A in that it includes a substantially U-shape plug pin 42. The other configuration is identical to that of the screw terminal block 10A, so the description of the screw terminal block 10B is omitted. The screw terminal block 10A will be described with reference to FIGS. 6A to 6C.

The screw terminal block 10A includes a terminal plate 12 with an insertion hole 12*a* through which a terminal screw 11 is to be inserted; and a fastening plate 13 with a screw hole 13*a* to which the terminal screw 11 inserted through the insertion hole 12*a* is to be screwed. Each electric cord 72 of a multi-core cable 70, which is configured by grouping a plurality of twisted wires, is connected to a terminal plate 12; and the multi-core cable 70 is extended outside from the plug body 20.

The fastening plate 13 is formed into a substantially rectangular shape, when viewed from the front, by pressing a metal plate. Protrusions 13*b* are provided in center portions of both left and right sides of the fastening plate 13 in FIG. 6A, respectively.

Figure 6A:
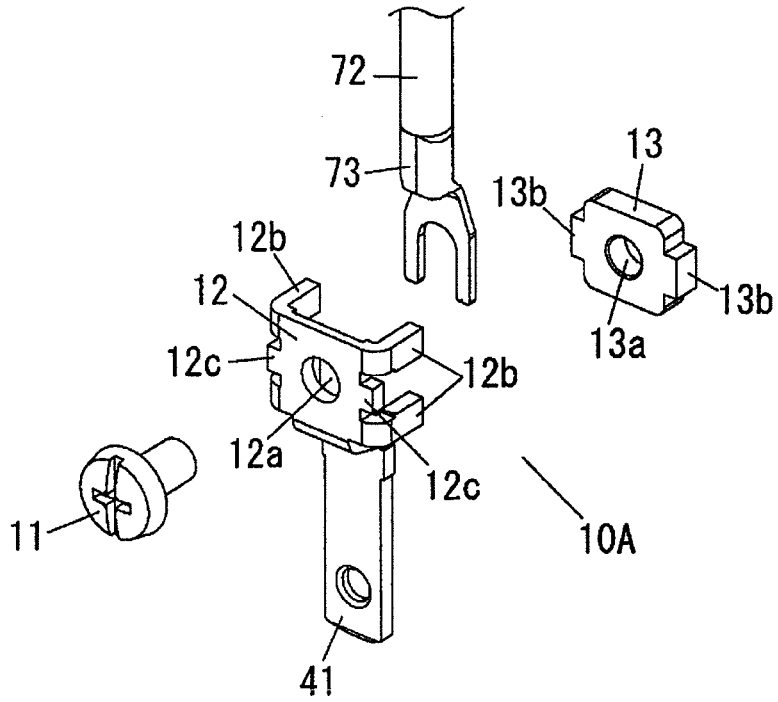
Figure 6B:
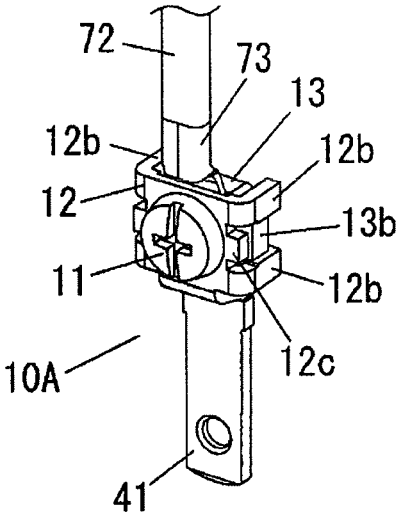
Figure 6C:
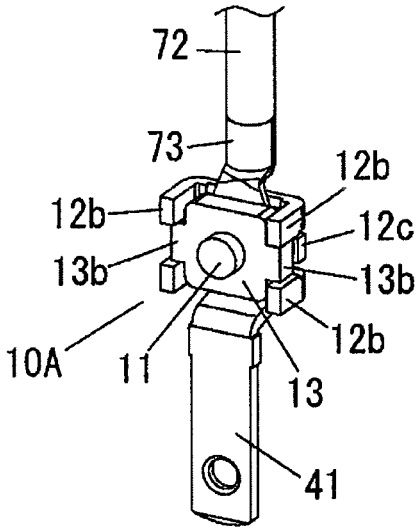

The terminal plate 12 is formed into a substantially rectangular shape, when viewed from the front, by pressing a highly conductive metal plate. The plug pin 41 with a flat shape extending downward from a lower edge of the terminal plate 12 in FIG. 6A is provided integrally with the terminal plate 12. On left and right sides of the terminal plate 12, there are provided locking pieces 12*b* protruding toward the fastening plate 13 from upper and lower portions of the terminal plate 12 so as to interpose the protrusion 13*b* between the upper and lower locking pieces 12*b*. Further, on the left and right sides of the terminal plate 12, there are provided protrusions 12*c* extending outward in the left and right directions respectively from an intermediate portion between the upper and lower locking pieces 12*b*, 12*b*. The protrusion 12*c* protrudes in the right-left direction beyond the protrusion 13*b*, that is, the protrusion 13*b* is located inside the protrusion 12*c* in the left-right direction. Herein, the locking piece 12*b* of the terminal plate 12 and the protrusion 13*b* of the fastening plate 13 configure a rotation restriction part for restricting the relative rotation of the terminal plate 12 and the fastening plate 13. Note that, although provided on both sides of the insertion hole 12*a* in the present embodiment, the rotation restriction part may be provided on only one side of the insertion hole 12*a*.

The terminal screw 11 is inserted through the insertion hole 12*a* of the terminal plate 12 and screwed into the screw hole 13*a* of the fastening plate 13. When the terminal screw 11 is made to rotate in a fastening direction, the protrusion 13*b* comes into contact with the locking piece 12*b*, thereby restricting the rotation of the fastening plate 13. When the terminal screw 11 is further rotated in the fastening direction from this state, the terminal screw 11 comes into screw engagement with the screw hole 13*a* because the rotation of the fastening plate 13 is restricted. When the torque of fastening the terminal screw 11 reaches a predetermined value, an operator stops screwing the terminal screw 11. When a conductive part of an electric cord 72 or a crimped terminal 73 swaged to the conductive part is interposed between the terminal plate 12 and the fastening plate 13, the terminal plate 12 and the fastening plate 13 clamp the conductive part or the crimped terminal 73 therebetween, so that the conductive part or the crimped terminal 73 is connected to the screw terminal block 10A. Further, in the state where the terminal plate 12 and the fastening plate 13 are fixed by using the terminal screw 11, the protrusion 13*b* comes into contact with the locking piece 12*b*, whereby the fastening plate 13 is restricted to rotate in a direction of loosening the terminal screw 11. Accordingly, in the state where the electric cord 72 is in connection with the screw terminal block 10A, even if the electric cord 72 is pulled and the torque of loosening the terminal screw 11 is applied to the crimped terminal 73, the rotation of the fastening plate 13 will be restricted because the protrusion 13*b* of the fastening plate 13 is in contact with the locking piece 12*b*. Thus, the fastening plate 13 is hardly rotated in the direction of loosening the terminal screw 11 in conjunction with the crimped terminal 73, so that the terminal screw 11 becomes difficult to rotate in the loosening direction. Note that, in the state where the terminal screw 11 is fastened, if the terminal screw 11 is rotated inversely to the fastening direction, the fastening plate 13 is rotated in conjunction with the terminal screw 11. When the fastening plate 13 is rotated as the terminal screw 11 is rotated, the protrusion 13*b* of the fastening plate 13 comes into contact with the locking piece 12*b*, whereby the rotation of the fastening plate 13 is restricted. When further rotated in the loosening direction from this state, the terminal screw 11 remains rotated in the loosening direction because the rotation of the fastening plate 13 is restricted. This releases the state where the conductive part or the crimped terminal 73 is connected in between the terminal plate 12 and the fastening plate 13.

Secondly, the plug body 20 will be described in detail. The plug body 20 is, as shown in FIGS. 1A to 5 and FIGS. 7A and 7B, configured by assembling: a body block 26 constituted by a body 21 and a cover 22, each being made of synthetic resin; and a shell 23 made of synthetic resin.

The shell 23 integrally includes: a cylinder part 23*a* in which the body block 26 (including the body 21 and the cover 22) is accommodated; and a back wall 23*b* disposed on a rear end of the cylinder part 23*a*. In a center portion of the back wall 23*b*, there is provided a circular hole 23*c* for passing the multi-core cable 70 connected to the screw terminal blocks 10A, 10A and 10B therethrough. On a rear surface of the back wall 23*b*, boss sections 23*e* with an insertion hole 23*d* are provided on left and right sides of the circular hole 23*c*, respectively. Further, on an outer periphery of the cylinder part 23*a*, a protrusion 23*f* for indicating a position of the ground plug pin 42 is provided so as to correspond to the ground plug pin 42.

The body 21, having a substantially disc shape as shown in FIGS. 1A to 5 and FIGS. 7A and 7B, is attached to the shell 23 so as to close an opening provided in a front side of the shell 23. In the body 21, there are provided two insertion holes 21*a* through which the power plug pins 41 with a flat shape (hereinafter, referred to as "plug blade") are inserted respectively; and an insertion hole 21*b* through which the ground plug pin 42 with the substantially U-shape (hereinafter, referred to as "plug pin") is inserted, each of which passes through the body 21 in the front-rear direction. The power screw terminal blocks 10A, 10A and the ground screw terminal block 10B are held in the body 21 in the state where the plug blades 41, 41 and the plug pin 42 are inserted through the corresponding insertion holes 21*a*, 21*a*, and 21*b* respectively. In a center portion of a rear surface of the body 21, there is provided a screw hole 21*c* for fixing the cover 22 by using a screw. Further, in the body 21, there are provided two insertion holes 21*d* through which mounting screws 25 for fixing the body 21 to the shell 23 are inserted respectively, and the insertion hole 21*d* is formed through the body 21 in the front-rear direction. Furthermore, in a front surface of the body 21, a recess 21*e* for avoiding interference with a screw head of the mounting screw 25 is provided around an outer periphery of the each insertion hole 21*d*.

The cover 22, having a substantially disc shape as shown in FIGS. 1A and 1B, 4, and 5, is placed on the rear surface of the body 21. A mounting screw 24 inserted through a stepped hole 22*a*, provided in a substantially center portion of the cover 22, is screwed into the screw hole 21*c* of the body 21 to fix the cover 22 on the body 21, thereby configuring the body block 26. In order to avoid interference with the screw terminal blocks 10A, 10A and 10B, recessed grooves 22*b* with a substantially U-shape are provided in the cover 22 so as to correspond to the screw terminal blocks 10A, 10A and 10B. Further, insertion holes 22*c* for passing a screw therethrough are provided in the cover 22 so as to correspond to the respective insertion holes 21*d* of the body 21. Around a peripheral portion of the insertion hole 22*c* in a rear surface of the cover 22, there are provided recesses 22*d* into which the boss sections provided in the shell 23 are to be fitted. Note that, in the state where the body 21 and the cover 22 are coupled with each other, the terminal plate 12 and the fastening plate 13 of each of the screw terminal blocks 10A, 10A and 10B are exposed from each recessed groove 22*b*. Therefore, a conductive wire or a crimped terminal can be inserted in between the terminal plate 12 and the fastening plate 13 through the recessed groove 22*b*. Further, the terminal screws 11 of the respective screw terminal blocks 10A, 10A and 10B are exposed from the recesses disposed in the periphery of the body 21 and the cover 22. Therefore, the terminal screw 11 can be fastened or loosened by using such a tool as a screw driver.

Next, the electric wire positioning member 30 will be described with reference to FIGS. 1A and 1B, 4, and 5. The electric wire positioning member 30, molded of synthetic resin, integrally includes a cylinder part 31 formed into a substantially cylindrical shape; and three hooking pieces 32 extending outward from a circumferential surface of the cylinder part 31. The three hooking pieces 32, formed into a substantially L-shape, are disposed so as to correspond to the respective three recessed grooves 22*b* of the cover 22. In the peripheral surface of the cylinder part 31, there is provided a slit 33 extending from a root of each of the three hooking pieces 32 to a rear end of the cylinder part 31. Further, on an inner periphery of the rear end of the cylinder part 31, there is provided a stepped portion 39 protruding inward (toward its center direction) so as to have an inner diameter smaller than that of the rear end. The tip end of a sheath 71 of the multi-core cable 70 comes into contact with the stepped portion 39, so that the amount of the sheath 71 pressed into the cylinder part 31 is limited. Furthermore, in a front portion of the cylinder part 31, three flat portions 34 are formed on its circumferential surface. The flat portions 34 come into contact with corresponding three protrusions 22*e* provided on the rear surface of the cover 22, so that the cylinder part 31 is positioned in alignment with the cover 22.

The wire clamping part 50 includes supporting bodies 51 and 52 assembled to form a cylindrical shape for interposing the multi-core cable 70 therebetween; and two pairs of mounting screw 53 and nut 54 for coupling the supporting bodies 51 and 52, as shown in FIGS. 2A to 5. Each of the supporting bodies 51 and 52 has such a semi-cylindrical shape obtained by dividing a cylinder into two pieces by a plane containing its rotation axis. On outer peripheries of the supporting bodies 51 and 52, there are respectively provided recessed grooves 51*a* and 52*a* with which an elastic band 60 is engaged. On inner surfaces of the supporting bodies 51 and 52 to be coupled with each other, a plurality of protrusion pieces 51*b* and 52*b* is formed at intervals in the front-rear direction around a center of the cylinder formed by the supporting bodies 51 and 52. The protrusion pieces 51*b* and 52*b* serve to prevent the multi-core cable 70 from being affected by a tensile stress applied thereto by biting the sheath 71 of the multi-core cable 70.

The attachment plug 1, having the above configurations, is assembled as follows.

Figure 7A:
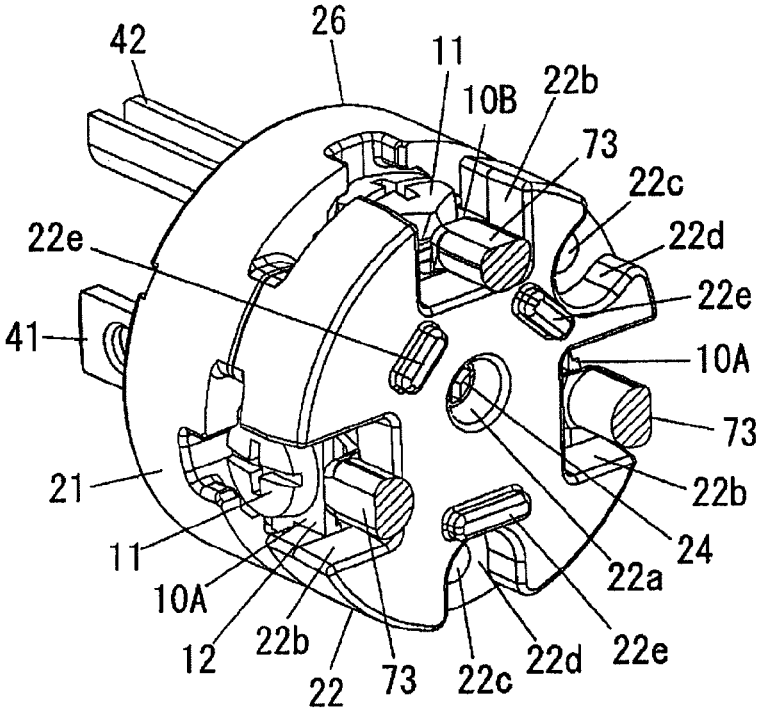
Figure 7B:
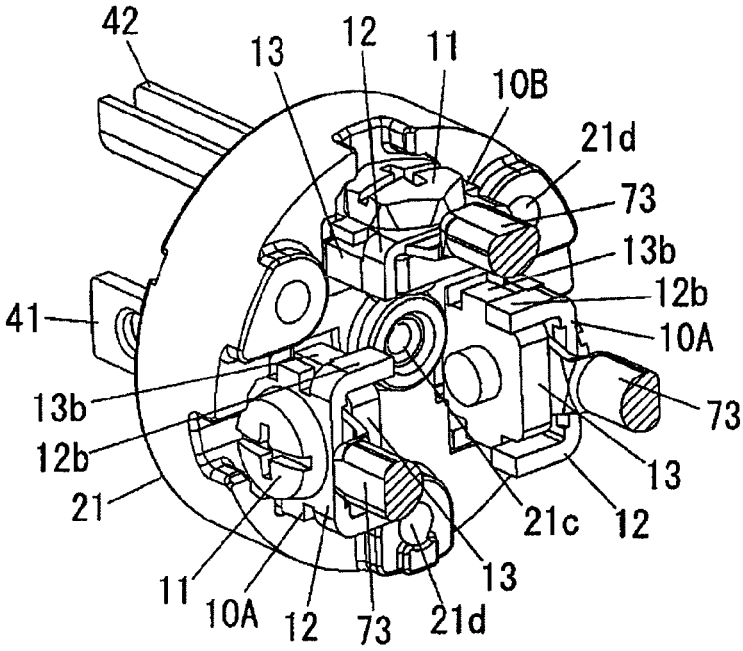

Firstly, an operator inserts the plug blades 41 and 41 into the insertion holes 21*a* and 21*a* of the body 21, and inserts the plug pin 42 into the insertion hole 21*b*, whereby the screw terminal blocks 10A, 10A and 10B are held in the body 21 (see FIG. 7B). Secondly, the operator places the cover 22 on the rear surface of the body 21 and then screws the mounting screw 24, inserted through the stepped hole 22*a* of the cover 22, into the screw hole 21*c* of the body 21, whereby the cover 22 is fixed to the body 21 (see FIG. 7A). At this time, the screw terminal blocks 10A, 10A and 10B are interposed between the body 21 and the cover 22, and held by the body block 26.

Figure 8A:
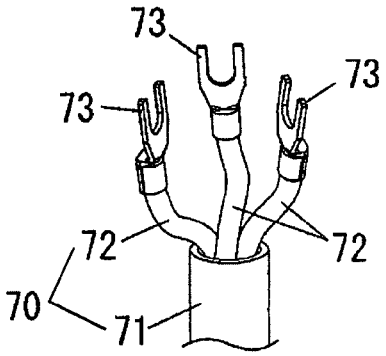
FIGS. 8A to 8E are explanatory views for explaining an assembly procedure of the attachment plug.
Figure 8B:
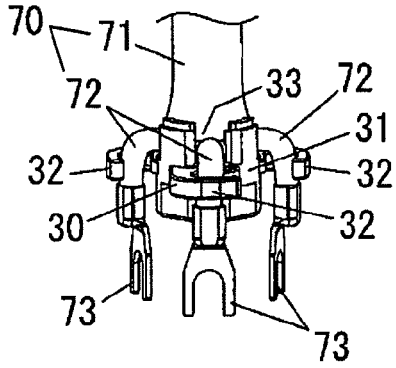
Figure 8C:
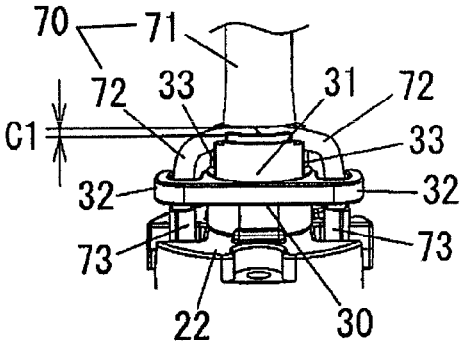
Figure 8D:
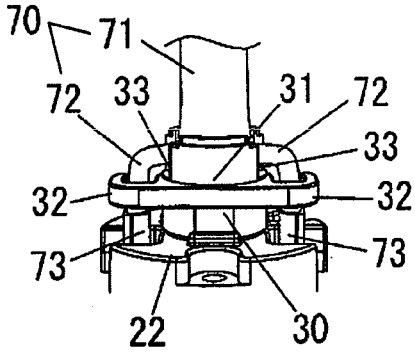
Figure 8E:
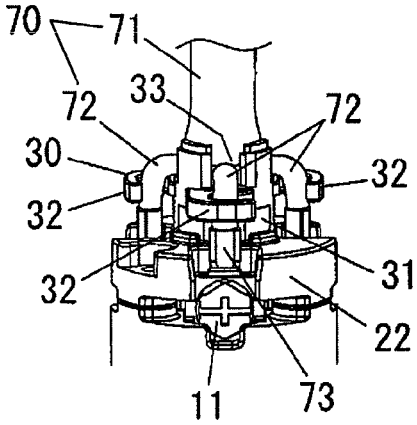

Next, the operator inserts the multi-core cable 70 through the circular hole 23*c* of the shell 23, and swages the respective crimped terminals 73 onto a tip end of each electric cord 72 exposed by stripping a tip end portion of the sheath 71. As shown in FIG. 8A, the three electric cords 72 are bent at substantially a right angle around an outlet of the sheath 71 respectively. An intermediate portion of the each electric cord 72 is further bent at substantially a right angle, so that the crimped terminals 73, swaged on the each electric cord 72, are aligned so as to direct the same direction. When the multi-core cable 70 is inserted into the electric wire positioning member 30 from the above with the slit 33 directed upward as shown in FIG. 8B, the three hooking pieces 32 of the electric wire positioning member 30 hold the corresponding electric cords 72 respectively. The three hooking pieces 32 are arranged at the same intervals as those of the screw terminal blocks 10A, 10A and 10B. Accordingly, the electric cords 72 held by the hooking pieces 32 are aligned so as to correspond to the screw terminal blocks 10A, 10A and 10B. Meanwhile, the operator loosens the terminal screw 11 of each of the screw terminal blocks 10A, 10A and 10B to provide a gap between the terminal plate 12 and the fastening plate 13. When the operator brings the electric wire positioning member 30 near the body block 26, the crimped terminal 73 swaged on the electric cord 72 is inserted into between the corresponding terminal plate 12 and fastening plate 13 via the corresponding recess groove 22*b* of the cover 22 as shown in FIG. 8C. In this state, the gap C1 remains between the tip end of the sheath 71 and the top end of the electric wire positioning member 30. When the operator pushes the multi-core cable 70 toward the electric wire positioning member 30 so as to eliminate this gap C1, the sheath 71 is inserted inside the cylinder part 31 (see FIG. 8D). At this time, when the tip end of the sheath 71 comes into contact with the stepped portion 39 provided in the inner periphery of the cylinder part 31, the sheath 71 is restricted from being inserted beyond a predetermined position inwardly (toward the screw terminal block). This maintains the tip end of the sheath 71 at substantially a constant position. Then, the operator rotates the terminal screw 11 in the fastening direction and tightens it to a predetermined torque, so that the crimped terminal 73 of each of the electric cords 72 is interposed between the corresponding terminal plate 12 and the fastening plate 13 (see FIG. 8E). Note that, in this state, the flat portions 34 of the electric wire positioning member 30 are in contact with the protrusions 22*e* on the cover 22, thereby allowing the cylinder part 31 to be located at a correct position relative to the cover 22 (i.e., the body block 26).

When completing the operation of connecting the electric cords 72 to the respective screw terminal blocks 10A, 10A and 10B, the operator covers the electric wire positioning member 30 and the body block 26 with the shell 23. Then, the mounting screw 25 inserted through the insertion holes 21*d* and 22*c* is screwed into a screw hole (not shown) provided within the shell 23 to fix the body block 26 in the opening of the shell 23. Next, in the state where the supporting bodies 51 and 52 are coupled together so as to sandwich the boss section 23*e* of the shell 23 therebetween, the operator inserts the mounting screws 53 into the nuts 54 through the insertion holes 51*c*, 52*c* of the supporting bodies 51, 52 and the insertion hole 23*d* of the boss section 23*e*, whereby the supporting bodies 51, 52 are coupled to the rear end of the shell 23. At this time, the sheath 71 of the multi-core cable 70 is interposed between the supporting bodies 51 and 52, thereby avoiding the multi-core cable 70 from being affected by a tensile stress applied thereto. Note that, the screw head of the mounting screw 53 and the nut 54 are accommodated within recesses formed in the outer periphery of the supporting bodies 51 and 52 respectively, so that the screw head of the mounting screw 53 and the nut 54 are not protruded outward from the outer periphery of the supporting bodies 51 and 52. Finally, the elastic band 60 is engaged with the recessed grooves 51*a* and 52*a*, so that the assembly of the attachment plug 1 is completed.

As described above, the electric wire positioning member 30 is provided with a first positioning restriction part (including the peripheral edges of the slits 33 and the hooking pieces 32 in the present embodiment). The first positioning restriction part holds the electric cords 72 exposed outside by stripping the sheath 71 covering the electric cords 72, in the state where the electric cords 72 are positioned to correspond to the respective terminal blocks (the screw terminal blocks 10A and 10B in the present embodiment).

In this manner, since the first positioning restriction part holds the electric cords 72 in the state where the electric cords 72 are positioned to correspond to the terminal blocks, the electric cords 72 can easily be connected to the corresponding terminal blocks even if the length of each of the exposed electric cords 72 (i.e., the extra length of each electric cord) is short, which improves the workability thereof.

Further, the first positioning restriction part of the electric wire positioning member 30 includes a first restriction part and a second restriction part. The first restriction part (the peripheral edges of the slits 33 in the present embodiment) positions the roots of the electric cords 72 exposed from the sheath 71 covering the electric cords 72. The second restriction part (the hooking pieces 32 in the present embodiment) positions the tip end portions of the electric cords 72 to be connected to the corresponding terminal blocks.

Thus, since the roots of the electric cords 72 (exposed from the sheath 71) and the tip end portions thereof (connected to the corresponding terminal blocks) are concurrently positioned, the positions of the electric cords 72 become stable. This makes it easier to connect the electric cords 72 to the corresponding terminal blocks. Note that, in the present embodiment, each of the electric cords 72 is held at its tip end portion and root by the hooking piece 32 and the peripheral edge of the slit 33 serving as the second and first restriction parts, respectively, but the present invention is not limited to the above. The electric cord 72 may be held at only its root or tip end portion by the first or second restriction part.

Moreover, the electric wire positioning member 30 has the flat portions 34 on the circumferential surface of the cylinder part 31. The protrusions 22*e* on the cover 22 are brought into contact with the flat portions 34, whereby the electric wire positioning member 30 is positioned relative to the cover 22 (i.e., the body block 26).

Thus, the electric wire positioning member 30 is correctly positioned relative to the body block 26, so that the electric cords 72 held by the electric wire positioning member 30 can be positioned more correctly relative to the terminal block.

Figure 9A:
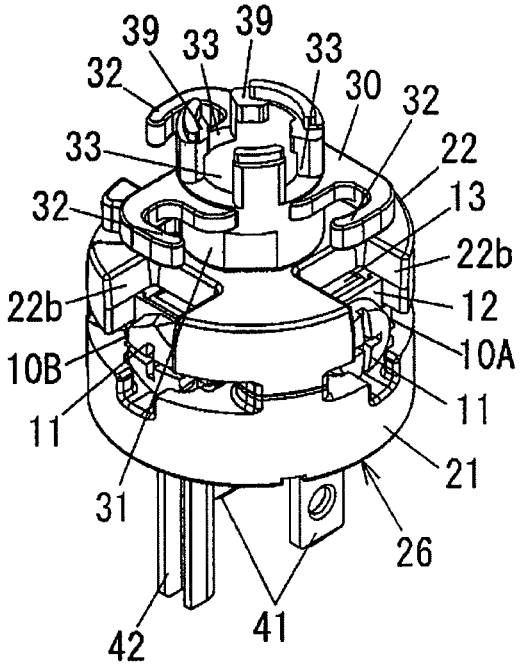
Figure 9B:
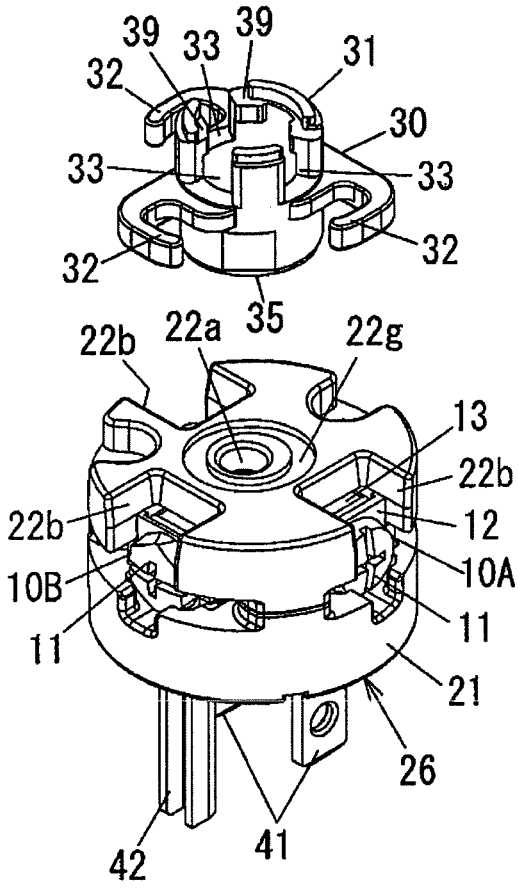
Figure 9C:
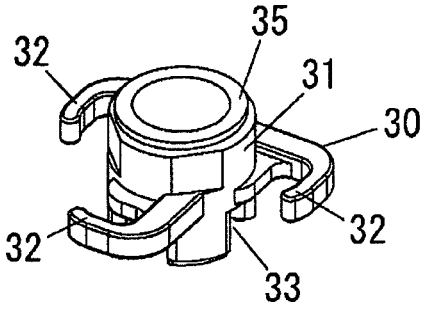

Note that, in the present embodiment, although the protrusions 22*e* to be in contact with the flat portions 34 of the electric wire positioning member 30 are provided on the cover 22, a protruding portion 35 protruding toward the body block 26 may be provided on the cylinder part 31 of the electric wire positioning member 30 as shown in FIG. 9C. In this case, the cover 22, constituting the body block 26, may include a recess portion 22*g* to be engaged with the protruding portion 35. The protruding portion 35 is engaged with the recess portion 22*g*, whereby the electric wire positioning member 30 is positioned relative to the body block 26.

As described above, the electric wire positioning member 30 includes the protruding portion 35 on its main body (the cylinder part 31 in the present embodiment) provided with the first positioning restriction part, in which the protruding portion 35 protrudes toward the body block 26 to which the terminal block is attached. On the other hand, in the body block 26, there is provided a positioning part for positioning the electric wire positioning member 30 (the recess portion 22*g* in the present embodiment) to be engaged with the protruding portion 35.

Thus, the electric wire positioning member 30 is correctly positioned relative to the body block 26 (the cover 22), so that the electric cords 72 held in the electric wire positioning member 30 can be positioned more correctly relative to the terminal blocks.

Still further, in the electric wire positioning member 30, the stepped portions 39 are provided on the inner periphery of the cylinder part 31 and the tip end of the sheath 71, into the cylinder part 31 comes into contact with the stepped portions 39, whereby the sheath 71 is prevented from being further inserted into the cylinder part 31. In other words, in the main body (the cylinder part 31 in the present embodiment) including the first positioning restriction part, there is provided a second positioning restriction part (the stepped portions 39 in the present embodiment) for preventing the sheath 71 covering the electric cords 72 from being inserted toward the terminal blocks beyond a predetermined position.

Thus, since the second positioning restriction part prevents the sheath 71 from being inserted toward the terminal blocks beyond the predetermined position, the tip end of the sheath 71 is maintained at substantially a constant position. Accordingly, in cases where the electric wire positioning member 30 is accommodated within the shell 23 together with the screw terminal blocks, the extra length of the electric cord 72 is ensured to be accommodated within the shell 23.

Furthermore, the attachment plug 1 of the present embodiment includes the plug pins, the terminal blocks, the body block 26, and the above electric wire positioning member 30. The terminal blocks (the screw terminal blocks 10A, 10B in the present embodiment) are electrically connected to the respective plug pins (the plug pins 41, 42 in the present embodiment) corresponding thereto. The body block 26 holding the terminal blocks is accommodated within the shell 23. The electric wire positioning member 30 holds the electric cords 72 included in the multi-core cable 70 introduced into the shell 23 from the outside, in the state where the electric cords 72 are positioned to correspond to the respective terminal blocks.

In this manner, since the first positioning restriction part of the electric wire positioning member 30 holds the electric cords 72 in the state where the electric cords 72 are positioned to correspond to the respective terminal blocks, the electric cords 72 can easily be connected to the corresponding terminal blocks even if the length of each of the exposed electric cords 72 (i.e., the extra length of each electric cord) is short, which improves the workability thereof. Moreover, the extra length of the electric cord can be shortened, thereby shortening the entire length of the attachment plug 1.

Further, the electric wire positioning member 30 includes the cylinder part 31 on which the first positioning restriction part is disposed, and the protruding portion 35 protruding toward the body block 26 may be provided on the cylinder part 31. In this case, on the body block 26, there is provided the positioning part (the recess portion 22*g* provided on the cover 22 in the present embodiment) engaged with the protruding portion 35 to position the electric wire positioning member 30.

Thus, since the electric wire positioning member 30 is correctly positioned relative to the body block 26, the electric cords 72 held in the electric wire positioning member 30 can be positioned relative to the screw terminal blocks more correctly.

Figure 10A:
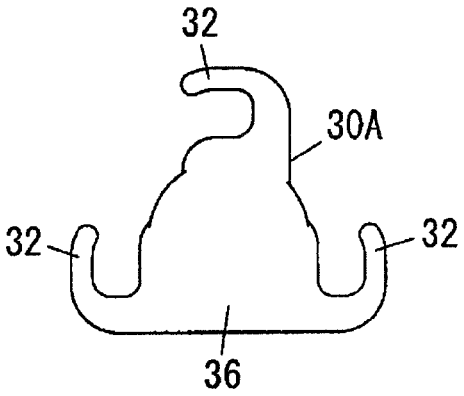
FIGS. 10A to 10D are plan views showing modifications of the electric wire positioning member used for the attachment plug.
Figure 10B:
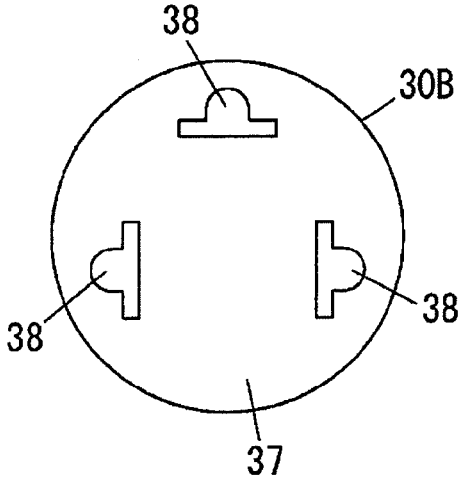

Note that, in the above embodiment, the first positioning restriction part of the electric wire positioning member 30 includes the first restriction part for holding the roots of the electric cords 72 and the second restriction part for holding the tip end portions of the electric cords 72 simultaneously, but may include only the second restriction part. In the electric wire positioning member 30A shown in FIG. 10A, substantially L-shaped three hooking pieces 32 (the second restriction part), each holding the tip end portion of the electric cord 72, are provided on an outer edge of a flat main body 36. Further, in the electric wire positioning member 30B shown in FIG. 10B, three through holes 38, each passing the electric cord 72 therethrough, are provided in a circular plate 37 made of synthetic resin. The second restriction part for holding the tip end portions of the electric cords 72 is constituted by the through holes 38. Note that each of the through holes 38 is formed by combining an elongated rectangular hole and a substantially semi-circular hole communicating with a center portion of one side of the rectangular hole, so that the crimped terminal 73 swaged on each electric cord 72 can be passed therethrough.

Figure 10C:
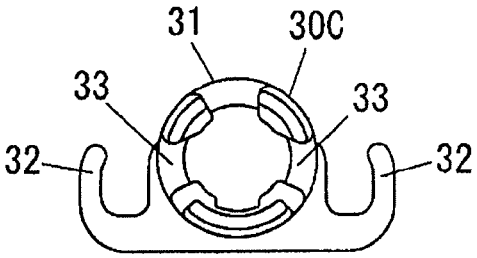
Figure 10D:
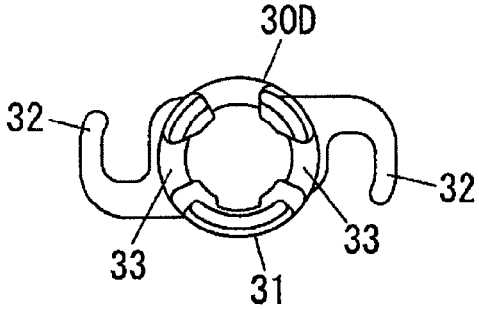

Furthermore, in the above embodiment, the electric wire positioning member 30 holds the three electric cords 72, but the number of electric cords 72 may be two, and four or more. FIGS. 10C and 10D illustrate electric wire positioning members 30C and 30D for holding two electric cords 72. In the electric wire positioning members 30C and 30D, two hooking pieces 32 for holding the tip parts of the respective electric cords 72 are provided on an outer periphery of the cylinder part 31. Note that the electric wire positioning member 30C has two hooking pieces 32 directed to the same direction; and the electric wire positioning member 30D has two hooking pieces 32 directed to opposite directions to each other.

While the invention has been shown and described with respect to the embodiments, it will be understood by those skilled in the art that various changes and modification may be made without departing from the scope of the invention as defined in the following claims.

What is claimed is:

1. An electric wire positioning member, comprising:

a first positioning restriction part configured to hold a plurality of electric cords, which is exposed from an end of a sheath that covers the electric cords, in a position to be connected to corresponding terminal blocks, the first positioning restriction part comprising:

a first restriction part configured to position roots of the electric cords exposed from the sheath; and a second restriction part configured to position tip end portions of the electric cords to be connected to the corresponding terminal blocks, wherein the first restriction part and the second restriction part are oriented generally perpendicular to each other, and wherein the first restriction part is defined by a plurality of slits extending in an axial direction of the positioning member and the second restriction part comprises a plurality of hooks oriented in a plane that is generally orthogonal to the axial direction of the positioning member.

2. The electric wire positioning member as set forth in claim 1, wherein a protruding portion is provided on a main body of the positioning member that includes the first positioning restriction part, and the protruding portion is adapted to be engaged with a recess portion provided in a body block to which the terminal blocks are attached.

3. The electric wire positioning member as set forth in claim 1, further comprising a main body that includes the first positioning restriction part, and wherein the second positioning restriction part is configured to restrict the sheath covering the electric cords from being inserted toward the terminal blocks beyond a predetermined position.

4. An attachment plug, comprising:

a plurality of plug pins;

a plurality of terminal blocks electrically connected to the respective plug pins corresponding thereto;

a body block holding the terminal blocks, the body block being accommodated within a shell; and the electric wire positioning member as set forth in claim 1, the electric wire positioning member holding the electric cords included in a multi-core cable introduced into the shell from outside in the state where the electric cords are positioned correspond to the terminal blocks.

5. The attachment plug as set forth in claim 4, wherein the electric wire positioning member comprises a main body including the first positioning restriction part, and a protruding portion protruding toward the body block is provided on the main body; and wherein the body block comprises a positioning part engaged with the protruding portion to position the electric wire positioning member.

* * * * *